United States Patent [19]

Coward

[11] 4,270,595

[45] Jun. 2, 1981

[54] SHROUD WITH REPLACEABLE EXTENSION

[75] Inventor: Michael D. Coward, Murrells Inlet, S.C.

[73] Assignee: Georgetown Steel Corporation, Georgetown, S.C.

[21] Appl. No.: 940,805

[22] Filed: Sep. 8, 1978

[51] Int. Cl.[3] ..... B22D 11/10

[52] U.S. Cl. ..... 164/415; 164/437; 266/217; 266/236

[58] Field of Search ..... 164/415, 259, 437, 418, 164/66, 82; 266/207, 217, 236; 222/603, 607; 138/118, 123, 127; 141/312, 392, 286

[56] References Cited

U.S. PATENT DOCUMENTS

| | | | |
|---|---|---|---|
| 2,410,753 | 11/1946 | Shinomiya | 138/118 X |
| 3,439,735 | 4/1969 | Holmes | 164/415 |
| 3,779,389 | 12/1973 | Fant | 164/418 X |
| 3,908,734 | 9/1975 | Pollard | 164/82 X |
| 4,084,799 | 4/1978 | Coward et al. | 164/437 X |

*Primary Examiner*—Robert D. Baldwin
*Assistant Examiner*—J. Reed Batten, Jr.
*Attorney, Agent, or Firm*—Ralph H. Dougherty

[57] ABSTRACT

Apparatus for protecting a molten metal pouring stream between a teeming vessel and a hot metal receiving mold beneath the vessel, including a heat resistant metal shroud tube, carrying at its lower extremity a replaceable, flexible, high temperature, heat resistant cloth tube extending downwardly therefrom.

12 Claims, 2 Drawing Figures

SHROUD WITH REPLACEABLE EXTENSION

BACKGROUND OF THE INVENTION

This invention relates to the continuous casting of molten metal, especially steel, and more particularly to the shrouding of molten metal pouring streams between a teeming vessel and a continuous casting mold, to protect such stream from atmospheric reoxidation.

In the continuous casting of molten metal such as steel, hot metal is teemed from a ladle into an intermediate pouring vessel, called a tundish, which is positioned above a continuous casting mold. The tundish has a pouring nozzle in its bottom wall. A tundish for continuous casting has a pouring nozzle for each strand to be poured. For instance, when continuously casting billets into a six strand continuous caster, the tundish would require six pouring nozzles.

Atmospheric oxygen contacts the pouring stream causing reoxidation of the stream as it flows between a tundish and a mold, resulting in the carryover and entrapment of undesirable oxide inclusions in each continuously cast strand. A continuous casting having inclusions trapped therein may be unacceptable for many applications. Certain quality steel grades require a high degree of product cleanliness. To alleviate the problem of reoxidation of a molten metal pouring stream, several methods have been developed to surround the pouring stream with a protective atmosphere, usually within a tubular enclosure. Holmes U.S. Pat. No. 3,439,735; Lyman U.S. Pat. No. 3,572,422; Newhall et al U.S. Pat. No. 3,616,843; and Pollard U.S. Pat. No. 3,908,734 teach shrouding of molten metal pouring streams with an inert or reducing gas. Some shroud enclosures are manufactured from refractory materials and are termed "refractory pouring tubes" since they project downwardly from the bottom of a tundish to a location beneath the surface of the metal in the mold as shown by Mills et al U.S. Pat. No. 3,517,726. This type of pouring tube affords no access to the tundish nozzle.

It is preferable to have a shroud enclosure form a gas-tight seal with the pouring vessel and extend downwardly as far as possible toward or into the mold. It is also desirable to have the tubular enclosure or shroud readily removable from the active position surrounding the pouring stream when the pouring nozzle becomes plugged and access to the nozzle is required. At such times an oxygen lance must usually be inserted in the pouring nozzle to re-establish the pouring stream. When a breakout occurs in the skin of the casting after it exits from the casting mold, it is desirable to shut off the flow of molten metal to the mold at which time a launder is positioned beneath the pouring nozzle to divert the stream from the mold. At other times, it is desirable to terminate casting by the insertion of a chill plug into the tundish nozzle to shut off the flow of metal.

It has been determined experimentally that the distance from the top of the liquid level in the mold to the bottom of the shroud enclosure is critical in limiting the percentage of oxygen in the gaseous environment within the shroud itself. Reoxidation of this molten metal stream will not occur if the oxygen concentration in the shroud is less than 0.80%, but will occur if the oxygen concentration is above 0.80%, forming undesirable oxide inclusions which will show up as defects in the cast product.

OBJECTS OF THE INVENTION

It is the principal object of this invention to provide an apparatus for shrouding a molten metal pouring stream between a bottom pour vessel and a mold which extends into the top of the mold.

It is also an object of this invention to provide a shroud apparatus which is readily removable from the active position between a mold and tundish without damaging any portion of the mold or tundish.

It is another object of this invention to provide a shroud apparatus having an adjustable length.

SUMMARY OF THE INVENTION

The present invention is a shroud tube supportable on a casting floor, tundish car or other convenient location, movable into and out of position between the pouring nozzle and the mold and extending into the mold after being placed without damage to the bottom edge of the shroud because the lower portion of the shroud is a flexible cloth material made of a high temperature, heat-resistant refractory cloth.

BRIEF DESCRIPTION OF THE DRAWINGS

This invention is better understood by reference to the following detailed description and the appended drawings in which.

DETAILED DESCRIPTION

Figure 1:
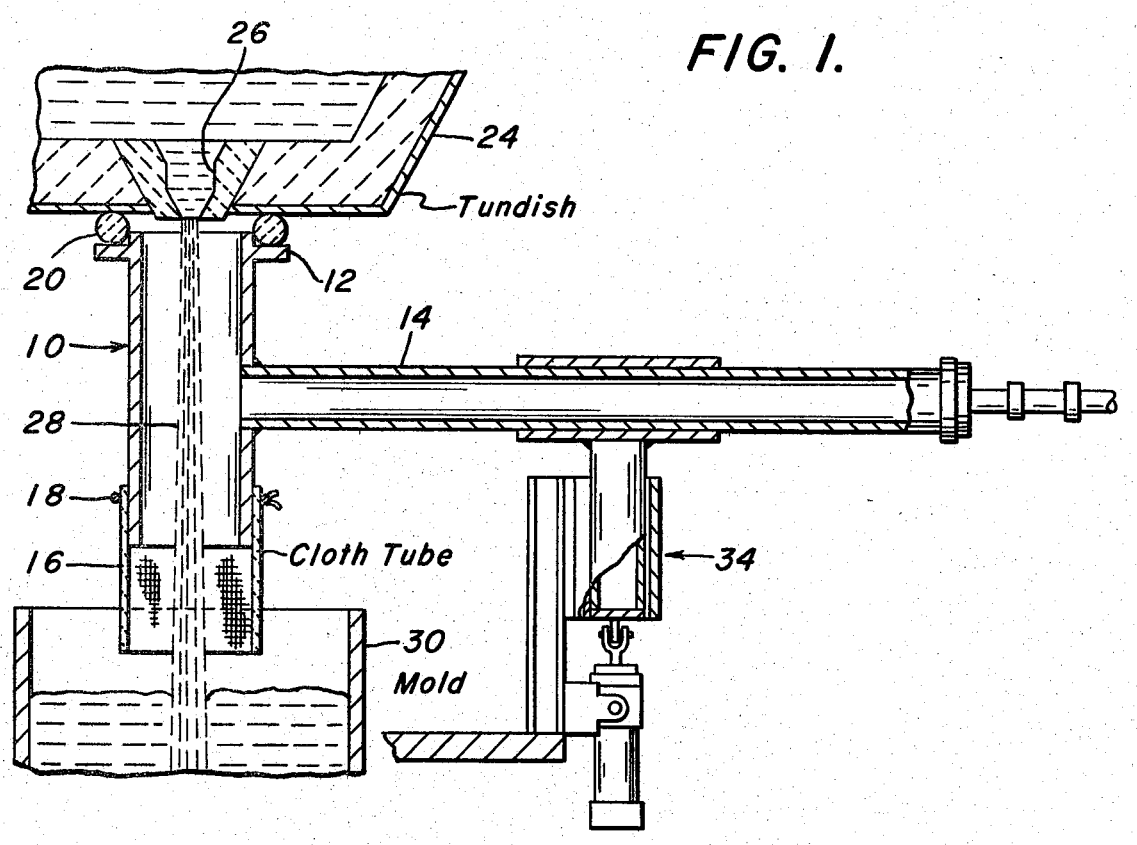
FIG. 1 is a sectional elevational view of the invented apparatus in the operative position between a bottom pour tundish and a continuous casting mold.

Referring now to FIG. 1, shroud tube 10 has an external gasket seat 12 at its upper end and a support arm 14 on its side for positioning the shroud tube and holding it in the operative position. The support arm can also serve as a gas conduit for conducting shrouding gas such as nitrogen, argon or other suitable protective gas to the interior of the shroud. Around the bottom of the tube 10 and extending downwardly therefrom is a refractory cloth tube 16 held in place by a spring clip 18. Alternatively the cloth tube 16 may be held by a steel band, or a wrap of wire or any other convenient retaining means.

In the active position, shroud 10 carries a compressible heat resistant material as a gasket 20 on gasket seat 12. The shroud 10 is a rigid tubular member preferably made of steel and preferably having a refractory lining.

Tundish 24 has a bottom-pour nozzle 26 through which a pouring stream of molten metal 28 discharges into mold 30. Any suitable mechanism 34 for positioning the shroud tube, such as that taught in U.S. Pat. No. 4,084,799, may be utilized for positioning and removing the shroud.

The invented shroud can be moved into and out of the operating position freely, the refractory cloth portion 16 of the shroud actually striking or dragging across the upper extremity of mold 30 whereupon the cloth tube 16 will flex. When the external forces are relieved from the cloth tube, it will immediately regain its cylindrical or tubular shape as it moves back into the open either totally within the outlines of the mold or totally without the mold.

The refractory cloth tube extension 16 is fabricated into a tube of any desired length having an internal diameter the same or approximately the same as the external diameter of the solid shroud tube 10 to which it will be attached. The refractory cloth tube 16 can be a single layer of cloth or can consist of two or more layers of cloth to reduce gas permeability.

Alternatively, the cloth can be treated with a graphite spray to reduce the voids in the weave of the material, or it can be impregnated with any non-metallic or metallic element, such as tungsten, or a compound such as silicon carbide, which improves its heat resistance without significantly reducing its flexibility.

The first tests of a cloth shroud extension employed a carbon fiber cloth tube, but it disintegrated upon contact by hot steel splash and spatter from the pouring stream. Suitable cloth is a woven high-temperature insulation cloth material that withstands disintegration from contact with molten metal splash and spatter up to at least 2800° F. such as REFRASIL cloth marketed by Hitco Materials, a division of Armco Steel Corporation, located in Gardena, Calif.

Figure 2:
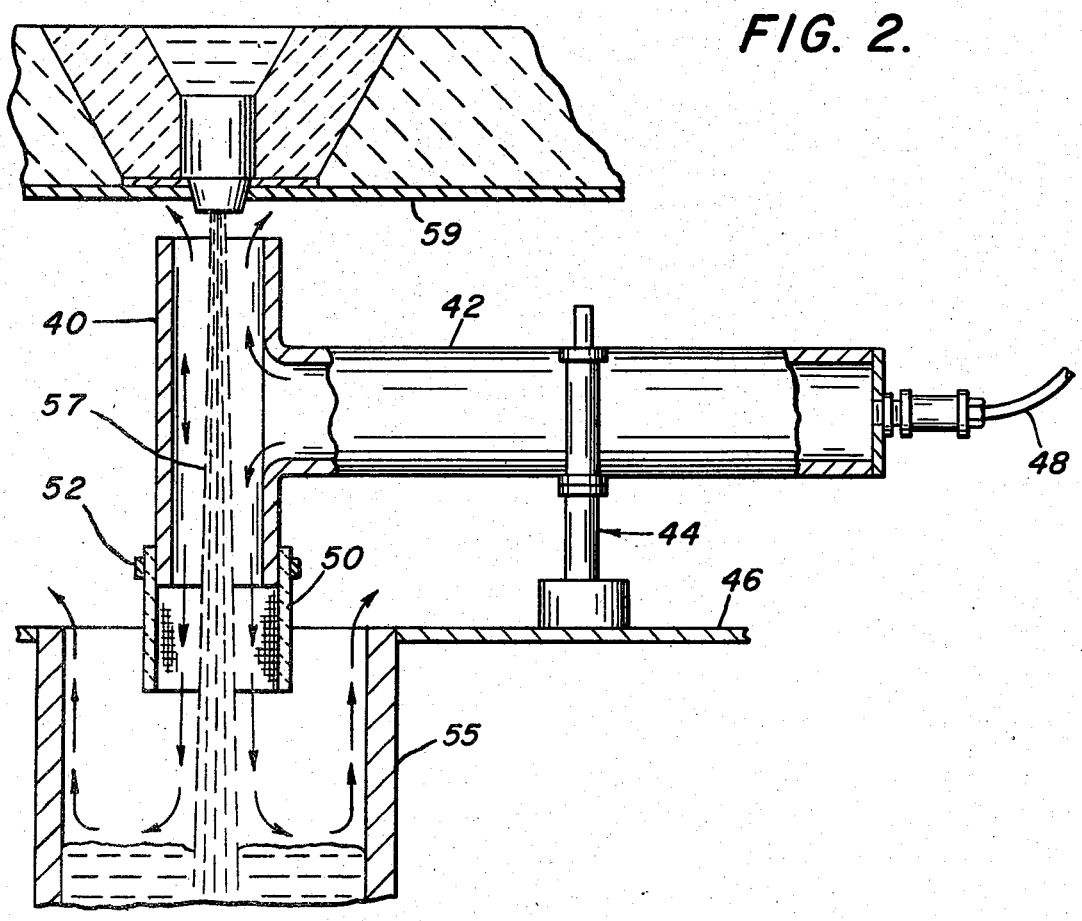
FIG. 2 is a partially sectioned elevational view of an alternative shroud configuration.

The present invention is applicable to any tubular shrouding device open at its lower end such as that taught by U.S. Pat. No. 3,908,734. FIG. 2 shows such a shroud with a cloth extension in accordance with the present invention. A vertical tubular shroud member 40, which surrounds the molten metal pouring stream in the active position, is connected to a horizontal tubular support member 42 in such manner to form a gas conduit to conduct shrouding gas to the interior of the shroud and to surround the pouring stream with shrouding gas both above and beneath the shroud. A positioning and pivoting means 44 situated on the pouring floor 46 permits the shroud to be pivoted about the positioning member into and out of the operative or active position. The shrouding gas is introduced to the interior of support member 42 from a gas supply means through gas supply tube 48. Refractory cloth extension 50 is removably attached to the lower end of shroud tube 40 by a spring clip or other retaining means 52. The shroud extension 50 may extend any desired distance into mold 55 to maintain the shrouding gas in close proximity with the pouring stream 57 for a greater distance than was heretofore possible.

The positioning and pivoting means 44 may be positioned on the bottom of tundish 59 or the tundish car (not shown) on which tundish 59 is situated.

While the refractory cloth extension 16 or 50 preferably extends downwardly from the rigid shroud tube into the mold, the invention comprehends an extension of any length. To insure that molten metal is shrouded the full distance between the tundish nozzle and the mold, the flexible cloth extension should extend downwardly at least to the lower limit of travel of the vertically oscillatible mold. Practically, the rigid tube should terminate at least two inches above the upper limit of travel of the oscillatible mold. This allows the shroud tube with extension to be pivoted into a standby position with relative ease.

The refractory cloth extension of this invention is readily replaceable if it becomes brittle from excessive heat or excessive contact with molten metal, or if a shorter or longer length shroud is desired. This invention does not interfere with the operation of continuous casting but enables a removable shroud to be used in the production of higher quality continuously cast steel than was heretofore possible with such shroud.

What is claimed is:

1. In a shrouding apparatus for protecting a molten metal pouring stream between a bottom pour vessel nozzle and a hot metal receiving vessel, including a rigid first tubular member positionable between said nozzle and the top of said receiving vessel and adapted for a liquid pouring stream to pass therethrough, and means for supporting said first tubular member and holding it in an operative position beneath said nozzle and spaced above said receiving vessel, the improvement comprising:

a second tubular member removably attached to the exterior of the bottom of said first tubular member and extending downwardly therefrom into said receiving vessel, said second tubular member being a flexible, high-temperature heat-resistant, refractory cloth tube open at its lower end; and retaining means for holding said second tubular member in place on said rigid first tubular member.

2. Apparatus according to claim 1 wherein said rigid tubular member is steel.

3. Apparatus according to claim 1 wherein said rigid tubular member is refractory lined steel.

4. Apparatus according to claim 1 wherein said retaining means is a spring clip encircling said rigid tubular member.

5. Apparatus according to claim 1 further comprising means for introducing a protective atmosphere to the interior of said rigid tubular member.

6. Apparatus according to claim 1 wherein said receiving vessel is a vertically oscillatible mold, and said rigid tubular member terminates at least two inches above the upper limit of movement of the oscillatible mold.

7. Apparatus according to claim 6 wherein said second tubular member extends downwardly at least to the lower limit of travel of the vertically oscillatible mold.

8. Apparatus according to claim 1 wherein said refractory cloth tube is impregnated with a particulate heat resistant material.

9. Apparatus according to claim 8 wherein said refractory cloth tube is treated with graphite.

10. Apparatus according to claim 1 further comprising means for moving said tubular members into and out of the operative position.

11. Apparatus according to claim 1 further comprising a third tubular member communicating with said first tubular member for admitting a gas to the interior of the first and second tubular members.

12. Apparatus according to claim 1 wherein said second tubular member is capable of withstanding disintegration at temperatures up to at least 2800° F.

* * * * *